US011353022B2

(12) United States Patent
Oh et al.

(10) Patent No.: US 11,353,022 B2
(45) Date of Patent: Jun. 7, 2022

(54) COMPRESSOR HAVING DAMPED SCROLL

(71) Applicant: Emerson Climate Technologies, Inc., Sidney, OH (US)

(72) Inventors: JonYeon Oh, Dayton, OH (US); Joseph M. Shepherd, Lima, OH (US); Brian J. Knapke, Troy, OH (US); Srinivasan Ramalingam, Sidney, OH (US); Gui Lin, Sidney, OH (US); Steven J. Baker, Sidney, OH (US); Miles E. Strand, St. Marys, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 55 days.

(21) Appl. No.: 16/886,145

(22) Filed: May 28, 2020

(65) Prior Publication Data

US 2021/0372407 A1 Dec. 2, 2021

(51) Int. Cl.
*F04C 18/02* (2006.01)
*F04C 29/06* (2006.01)

(52) U.S. Cl.
CPC ..... *F04C 18/0215* (2013.01); *F04C 29/06* (2013.01); *F04C 29/063* (2013.01); *F04C 2240/805* (2013.01)

(58) Field of Classification Search
CPC .. F04C 18/0207–0292; F04C 2240/805; F04C 29/06; F04C 29/063; F04C 29/068;
(Continued)

(56) References Cited

U.S. PATENT DOCUMENTS 3,994,636 A 11/1976 McCullough et al.
4,767,293 A 8/1988 Caillat et al.
(Continued)

FOREIGN PATENT DOCUMENTS

CN 1740571 A 3/2006
CN 2900866 Y 5/2007
(Continued)

OTHER PUBLICATIONS

International Search Report regarding International Application No. PCT/US2013/038822, dated Aug. 12, 2013.
(Continued)

*Primary Examiner* — Mark A Laurenzi
*Assistant Examiner* — Xiaoting Hu
(74) *Attorney, Agent, or Firm* — Harness, Dickey & Pierce, P.L.C.

(57) ABSTRACT

A compressor may include a shell assembly, orbiting and non-orbiting scrolls, a bearing housing, a bushing, a damper, and a fastener. The bearing housing includes a first aperture. The bushing may include an axial end abutting the bearing housing. The bushing may extend through a second aperture of the non-orbiting scroll. The bushing may include a third aperture. The damper may be received in a pocket that may be defined by and disposed radially between an outer diametrical surface of the bushing and an inner diametrical surface of the non-orbiting scroll. The damper may be at least partially disposed within the second aperture and may encircle the second portion of the bushing. The fastener may include a shaft portion and a flange portion. The shaft portion may extend through the third aperture and into the first aperture. The flange portion may contact a first axial end of the damper.

20 Claims, 6 Drawing Sheets

(58) Field of Classification Search
CPC ..... F04C 2270/12; F04C 2270/13; F04B 39/044; F04B 53/003; F16B 5/0258
See application file for complete search history.

(56) References Cited

U.S. PATENT DOCUMENTS

| | | | | |
|---|---|---|---|---|
| 5,102,316 | A | 4/1992 | Caillat et al. | |
| 5,383,772 | A | 1/1995 | Richardson, Jr. et al. | |
| 5,445,507 | A | 8/1995 | Nakamura et al. | |
| 5,527,166 | A | 6/1996 | Chang et al. | |
| 5,547,355 | A | 8/1996 | Watanabe et al. | |
| 5,580,230 | A | 12/1996 | Keifer et al. | |
| 5,951,271 | A | 9/1999 | DuMoulin et al. | |
| 5,984,653 | A | 11/1999 | Misiak | |
| 6,027,321 | A | 2/2000 | Shim et al. | |
| 6,220,839 | B1 | 4/2001 | Sheridan et al. | |
| 6,280,155 | B1 | 8/2001 | Dreiman | |
| 6,345,966 | B1 * | 2/2002 | Hahn | F04C 27/005 418/55.1 |
| 6,422,842 | B2 | 7/2002 | Sheridan et al. | |
| 6,464,479 | B1 | 10/2002 | Saunders | |
| 6,786,707 | B2 | 9/2004 | Kim | |
| 6,821,092 | B1 | 11/2004 | Gehret et al. | |
| 7,070,401 | B2 | 7/2006 | Clendenin et al. | |
| 7,300,257 | B2 | 11/2007 | Lifson et al. | |
| 7,300,265 | B2 | 11/2007 | Stover | |
| 7,322,807 | B2 | 1/2008 | Clendenin et al. | |
| 7,553,140 | B2 | 6/2009 | Stover | |
| 7,717,687 | B2 | 5/2010 | Reinhart | |
| 7,918,658 | B2 | 4/2011 | Bush et al. | |
| 7,963,753 | B2 | 6/2011 | Bush | |
| 8,043,078 | B2 | 10/2011 | Stover et al. | |
| 8,628,312 | B2 | 1/2014 | Bergman et al. | |
| 8,932,036 | B2 | 1/2015 | Monnier et al. | |
| 9,022,756 | B2 | 5/2015 | Oh et al. | |
| 9,353,745 | B2 | 5/2016 | Lee et al. | |
| 9,366,254 | B2 | 6/2016 | Murakami | |
| 9,404,497 | B2 | 8/2016 | Siefring | |
| 9,435,339 | B2 | 9/2016 | Calhoun et al. | |
| 9,689,391 | B2 | 6/2017 | Fu et al. | |
| 10,458,409 | B2 | 10/2019 | Su et al. | |
| 10,544,786 | B2 | 1/2020 | Stover et al. | |
| 10,570,901 | B2 | 2/2020 | Stover et al. | |
| 2003/0055179 | A1 * | 3/2003 | Ota | C08L 53/00 525/242 |
| 2005/0201883 | A1 * | 9/2005 | Clendenin | F01C 21/003 418/55.5 |
| 2005/0220652 | A1 | 10/2005 | Yamaji et al. | |
| 2006/0093505 | A1 | 5/2006 | Tarng et al. | |
| 2006/0140807 | A1 | 6/2006 | Chang et al. | |
| 2006/0198748 | A1 | 9/2006 | Grassbaugh et al. | |
| 2006/0204378 | A1 | 9/2006 | Anderson | |
| 2007/0059192 | A1 | 3/2007 | Stover | |
| 2009/0071183 | A1 | 3/2009 | Stover et al. | |
| 2009/0185927 | A1 | 7/2009 | Duppert et al. | |
| 2010/0303659 | A1 | 12/2010 | Stover et al. | |
| 2011/0091341 | A1 | 4/2011 | Zamudio et al. | |
| 2011/0095659 | A1 * | 4/2011 | Hattori | H05K 1/0201 310/68 D |
| 2012/0098176 | A1 | 4/2012 | Matsushita | |
| 2012/0237381 | A1 * | 9/2012 | Murakami | F04C 29/068 418/55.1 |
| 2012/0285150 | A1 | 11/2012 | Kameda et al. | |
| 2013/0251574 | A1 | 9/2013 | Heusler et al. | |
| 2013/0287617 | A1 | 10/2013 | Siefring | |
| 2015/0152868 | A1 * | 6/2015 | Fu | F04C 18/0215 418/55.5 |
| 2015/0316055 | A1 | 11/2015 | Jin et al. | |
| 2016/0003253 | A1 | 1/2016 | Lee et al. | |
| 2017/0350396 | A1 | 12/2017 | Su et al. | |
| 2021/0017973 | A1 * | 1/2021 | Resch | F04B 53/003 |

FOREIGN PATENT DOCUMENTS

| | | | | |
|---|---|---|---|---|
| CN | 100543306 | C | 9/2009 | |
| CN | 100585128 | C | 1/2010 | |
| CN | 101910637 | A | 12/2010 | |
| CN | 202108733 | U | 1/2012 | |
| CN | 102588277 | A | 7/2012 | |
| CN | 103122855 | A | 5/2013 | |
| CN | 103225610 | A | 7/2013 | |
| CN | 102878078 | B | 9/2015 | |
| CN | 207145228 | U | 3/2018 | |
| EP | 1577558 | A2 | 9/2005 | |
| FR | 3059733 | A1 * | 6/2018 | F04B 39/044 |
| GB | 2217814 | B | 10/1992 | |
| JP | H02277995 | A | 11/1990 | |
| JP | H045490 | A | 1/1992 | |
| JP | H0777188 | A | 3/1995 | |
| JP | H0932752 | A | 2/1997 | |
| JP | H1061568 | A | 3/1998 | |
| JP | 10122166 | A * | 5/1998 | |
| JP | 2002161876 | A | 6/2002 | |
| JP | 2010138808 | A | 6/2010 | |
| JP | 2014214702 | A | 11/2014 | |
| JP | 2016102487 | A | 6/2016 | |
| KR | 970002628 | Y1 | 3/1997 | |
| KR | 20050008475 | A | 1/2005 | |
| KR | 20070030111 | A | 3/2007 | |
| KR | 20110010135 | A | 1/2011 | |
| WO | WO-2015081261 | A1 | 6/2015 | |

OTHER PUBLICATIONS

Written Opinion of the International Searching Authority regarding International Application No. PCT/US2013/038822, dated Aug. 12, 2013.
Office Action regarding U.S. Appl. No. 13/856,891, dated Sep. 12, 2014.
Office Action regarding U.S. Appl. No. 13/856,891, dated Feb. 26, 2015.
International Search Report regarding International Application No. PCT/US2014/067716, dated Mar. 10, 2015.
Written Opinion of the International Searching Authority regarding International Application No. PCT/US2014/067716, dated Mar. 10, 2015.
Applicant-Initiated Interview Summary regarding U.S. Appl. No. 13/856,891, dated Apr. 6, 2015.
Advisory Action regarding U.S. Appl. No. 13/856,891, dated May 7, 2015.
Office Action regarding U.S. Appl. No. 13/856,891, dated Aug. 24, 2015.
Office Action regarding Chinese Patent Application No. 201380022652.9, dated Nov. 4, 2015. Translation provided by Unitalen Attorneys at Law.
Office Action regarding U.S. Appl. No. 13/856,891, dated Feb. 8, 2016.
Notice of Allowance regarding U.S. Appl. No. 13/856,891, dated Jun. 8, 2016.
Office Action regarding Chinese Patent Application No. 201380022652.9, dated Jun. 29, 2016. Translation provided by Unitalen Attorneys at Law.
Office Action regarding U.S. Appl. No. 14/553,502, dated Aug. 10, 2016.
Office Action regarding Chinese Patent Application No. 201480065061.4, dated Feb. 4, 2017. Translation provided by Unitalen Attorneys at Law.
Notice of Allowance regarding U.S. Appl. No. 14/553,502, dated Feb. 7, 2017.
Office Action regarding Chinese Patent Application No. 201480065061.4, dated Jul. 10, 2017. Translation provided by Unitalen Attorneys at Law.
Search Report regarding European Patent Application No. 14865917.0, dated Jul. 31, 2017.
Search Report regarding European Patent Application No. 17174356.0, dated Oct. 24, 2017.

(56) References Cited

OTHER PUBLICATIONS

Office Action regarding Korean Patent Application No. 10-2016-7016250, dated Dec. 29, 2017. Translation provided by Y.S. Chang & Associates.
Office Action regarding Korean Patent Application No. 10-2017-0069179, dated Jul. 16, 2018. Translation provided by KS KORYO International IP Law Firm.
Office Action regarding Chinese Patent Application No. 201710414659.5, dated Sep. 19, 2018. Translation provided by Unitalen Attorneys at Law.
Office Action regarding Chinese Patent Application No. 201711330061.4, dated Nov. 5, 2018. Translation provided by Unitalen Attorneys at Law.
Office Action regarding U.S. Appl. No. 15/597,425, dated Dec. 20, 2018.
Office Action regarding U.S. Appl. No. 15/633,513, dated Mar. 7, 2019.
Office Action regarding U.S. Appl. No. 15/633,537, dated Mar. 7, 2019.
Notice of Allowance regarding U.S. Appl. No. 15/597,425, dated Apr. 17, 2019.
Applicant-Initiated Interview Summary regarding U.S. Appl. No. 15/633,537, dated Apr. 18, 2019.
Office Action regarding Chinese Patent Application No. 201711330061.4, dated May 21, 2019. Translation provided by Unitalen Attorneys at Law.
Office Action regarding U.S. Appl. No. 15/633,513, dated Jul. 11, 2019.
Office Action regarding U.S. Appl. No. 15/633,537, dated Jul. 11, 2019.
Advisory Action regarding U.S. Appl. No. 15/633,537, dated Sep. 25, 2019.
Notice of Allowance regarding U.S. Appl. No. 15/633,513, dated Sep. 27, 2019.
Notice of Allowance regarding U.S. Appl. No. 15/633,537, dated Oct. 24, 2019.
International Search Report regarding Application No. PCT/US2021/033903 dated Sep. 10, 2021.
Written Opinion of the ISA regarding Application No. PCT/US2021/033903 dated Sep. 10, 2021.

* cited by examiner

COMPRESSOR HAVING DAMPED SCROLL

FIELD

The present disclosure relates to a compressor having a damped scroll.

BACKGROUND

This section provides background information related to the present disclosure and is not necessarily prior art.

A compressor may include fasteners and sleeve guides or bushings that allow for limited axial displacement or axial compliance of a non-orbiting scroll relative to a bearing housing and orbiting scroll. Such displacement can produce undesirable noise. The present disclose provides bushings and dampers that may reduce undesirable noise produced during operation of the compressor.

SUMMARY

This section provides a general summary of the disclosure and is not a comprehensive disclosure of its full scope or all of its features.

The present disclosure provides a compressor that may include a shell assembly, an orbiting scroll, a non-orbiting scroll, a bearing housing, a bushing, a first damper, and a fastener. The orbiting scroll is disposed within the shell assembly and includes a first end plate and a first spiral wrap extending from the first end plate. The non-orbiting scroll includes a second end plate and a second spiral wrap extending from the second end plate. The second spiral wrap cooperating with the first spiral wrap to define compression pockets therebetween. The bearing housing is fixed relative to the shell assembly and may include a first aperture. The bushing may have an axial end abutting the bearing housing. The bushing may extend through a second aperture of the non-orbiting scroll. The bushing may include a first portion having a first diameter and a second portion having a second diameter that is smaller than the first diameter. The bushing may include a third aperture extending axially therethrough. The first damper may be received on the bushing. The first damper may be at least partially disposed within the second aperture and may encircle the second portion of the bushing. The fastener may include a shaft portion and a flange portion. The shaft portion may extend through the third aperture and into the first aperture. The flange portion may contact a first axial end of the first damper.

In some configurations of the compressor of the above paragraph, the first damper is solid annular member formed from an elastomeric material.

In some configurations of either of the above paragraphs, the first damper is formed from an elastomeric material that has a glass transition temperature less than or equal to −20° C., a hardness within the range of 40-95 Shore A, and a damping factor greater than or equal to 0.1 between temperatures of −40° C. and −20° C.

In some configurations of the compressor of any one or more of the above paragraphs, a second axial end of the first damper contacts an annular ledge of the bushing.

In some configurations of the compressor of the above paragraph, the annular ledge of the bushing defines a transition between the first and second portions of the bushing.

In some configurations of the compressor of any one or more of the above paragraphs, the second aperture of the non-orbiting scroll includes a first portion having first diameter and a second portion having a second diameter that is larger than the first diameter of the first portion of the second aperture.

In some configurations of the compressor of any one or more of the above paragraphs, the first damper is at least partially disposed within the second portion of the second aperture of the non-orbiting scroll.

In some configurations of the compressor of any one or more of the above paragraphs, the first damper contacts an annular ledge of the non-orbiting scroll that defines a transition between the first and second portions of the second aperture of the non-orbiting scroll.

In some configurations, the compressor of any one or more of the above paragraphs includes a second damper disposed within the second aperture of the non-orbiting scroll.

In some configurations of the compressor of the above paragraph, an axial end of the second damper contacts another annular ledge of the bushing.

In some configurations of the compressor of any one or more of the above paragraphs, another axial end of the second damper contacts a surface of the bearing housing.

In some configurations of the compressor of any one or more of the above paragraphs, another axial end of the second damper contacts an annular ledge of the non-orbiting scroll.

In some configurations of the compressor of any one or more of the above paragraphs, the first damper is clamped between the flange portion of the fastener and a surface of the bushing such that the flange portion of the fastener contacts an axial end of the bushing.

In some configurations, the compressor of any one or more of the above paragraphs includes a second damper disposed radially between the shell assembly and the non-orbiting scroll.

In some configurations of the compressor of any one or more of the above paragraphs, at least a portion of the second damper encircles the non-orbiting scroll.

In some configurations of the compressor of any one or more of the above paragraphs, the second damper contacts an inner diametrical surface of the shell assembly and a radially outer surface of the non-orbiting scroll.

In some configurations of the compressor of any one or more of the above paragraphs, a second portion of the second damper is disposed axially between a surface of the non-orbiting scroll and a surface of the bearing housing.

In some configurations of the compressor of any one or more of the above paragraphs, the second portion of the second damper contacts the surfaces of the non-orbiting scroll and the bearing housing.

In some configurations of the compressor of any one or more of the above paragraphs, the second damper has an L-shaped cross-sectional shape.

In some configurations, the compressor of any one or more of the above paragraphs includes a third damper disposed axially between a surface of the non-orbiting scroll and a surface of the bearing housing.

In some configurations of the compressor of the above paragraph, the third damper contacts the surfaces of the non-orbiting scroll and the bearing housing.

In another form, the present disclosure provides a compressor that may include a shell assembly, an orbiting scroll, a non-orbiting scroll, a bearing housing, a bushing, a first damper, and a fastener. The orbiting scroll is disposed within the shell assembly and includes a first end plate and a first spiral wrap extending from the first end plate. The non-orbiting scroll includes a second end plate and a second spiral wrap extending from the second end plate. The second spiral wrap cooperating with the first spiral wrap to define compression pockets therebetween. The bearing housing is fixed relative to the shell assembly and includes a first aperture. The bushing may include an axial end abutting the bearing housing. The bushing may extend through a second aperture of the non-orbiting scroll. The bushing may include a third aperture extending axially therethrough. The first damper may be received in a pocket that may be defined by and disposed radially between an outer diametrical surface of the bushing and an inner diametrical surface of the non-orbiting scroll. The first damper may be at least partially disposed within the second aperture and may encircle at least a portion of the bushing. The fastener may include a shaft portion and a flange portion. The shaft portion may extend through the third aperture and into the first aperture. The flange portion may contact a first axial end of the first damper.

In some configurations of the compressor of the above paragraph, the non-orbiting scroll includes a plurality of protrusions arranged in a circular pattern around the bushing.

In some configurations of the compressor of either of the above paragraphs, the protrusions contact the fastener.

In some configurations of the compressor of any one or more of the above paragraphs, the first damper is solid annular member formed from an elastomeric material.

In some configurations of any one or more of the above paragraphs, the first damper is formed from an elastomeric material that has a glass transition temperature less than or equal to −20° C., a hardness within the range of 40-95 Shore A, and a damping factor greater than or equal to 0.1 between temperatures of −40° C. and −20° C.

In some configurations of the compressor of any one or more of the above paragraphs, a second axial end of the first damper contacts an annular ledge of the bushing.

In some configurations of the compressor of any one or more of the above paragraphs, the annular ledge of the bushing defines a transition between first and second portions of the bushing.

In some configurations of the compressor of any one or more of the above paragraphs, the first portion of the bushing has a first diameter.

In some configurations of the compressor of any one or more of the above paragraphs, the second portion of the bushing has a second diameter that is different that the first diameter.

In some configurations of the compressor of any one or more of the above paragraphs, the second aperture of the non-orbiting scroll includes a first portion having first diameter and a second portion having a second diameter that is larger than the first diameter of the first portion of the second aperture.

In some configurations of the compressor of any one or more of the above paragraphs, the first damper is at least partially disposed within the second portion of the second aperture of the non-orbiting scroll.

In some configurations of the compressor of any one or more of the above paragraphs, the first damper contacts an annular ledge of the non-orbiting scroll that defines a transition between the first and second portions of the second aperture of the non-orbiting scroll.

In some configurations, the compressor of any one or more of the above paragraphs includes a second damper disposed within the second aperture of the non-orbiting scroll.

In some configurations of the compressor of any one or more of the above paragraphs, an axial end of the second damper contacts another annular ledge of the bushing.

In some configurations of the compressor of any one or more of the above paragraphs, another axial end of the second damper contacts a surface of the bearing housing.

In some configurations of the compressor of any one or more of the above paragraphs, another axial end of the second damper contacts an annular ledge of the non-orbiting scroll.

In some configurations of the compressor of any one or more of the above paragraphs, the first damper is clamped between the flange portion of the fastener and a surface of the bushing such that the flange portion of the fastener contacts an axial end of the bushing.

In some configurations, the compressor of any one or more of the above paragraphs includes a second damper disposed radially between the shell assembly and the non-orbiting scroll.

In some configurations of the compressor of any one or more of the above paragraphs, at least a portion of the second damper encircles the non-orbiting scroll.

In some configurations of the compressor of any one or more of the above paragraphs, the second damper contacts an inner diametrical surface of the shell assembly and a radially outer surface of the non-orbiting scroll.

In some configurations of the compressor of any one or more of the above paragraphs, a second portion of the second damper is disposed axially between a surface of the non-orbiting scroll and a surface of the bearing housing.

In some configurations of the compressor of any one or more of the above paragraphs, the second portion of the second damper contacts the surfaces of the non-orbiting scroll and the bearing housing.

In some configurations of the compressor of any one or more of the above paragraphs, the second damper has an L-shaped cross-sectional shape.

In some configurations, the compressor of any one or more of the above paragraphs includes a third damper disposed axially between a surface of the non-orbiting scroll and a surface of the bearing housing.

In some configurations of the compressor of any one or more of the above paragraphs, the third damper contacts the surfaces of the non-orbiting scroll and the bearing housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations. The drawings are not intended to limit the scope of the present disclosure.

Corresponding reference numerals indicate corresponding parts throughout the several views of the drawings.

DETAILED DESCRIPTION

Figure 1:
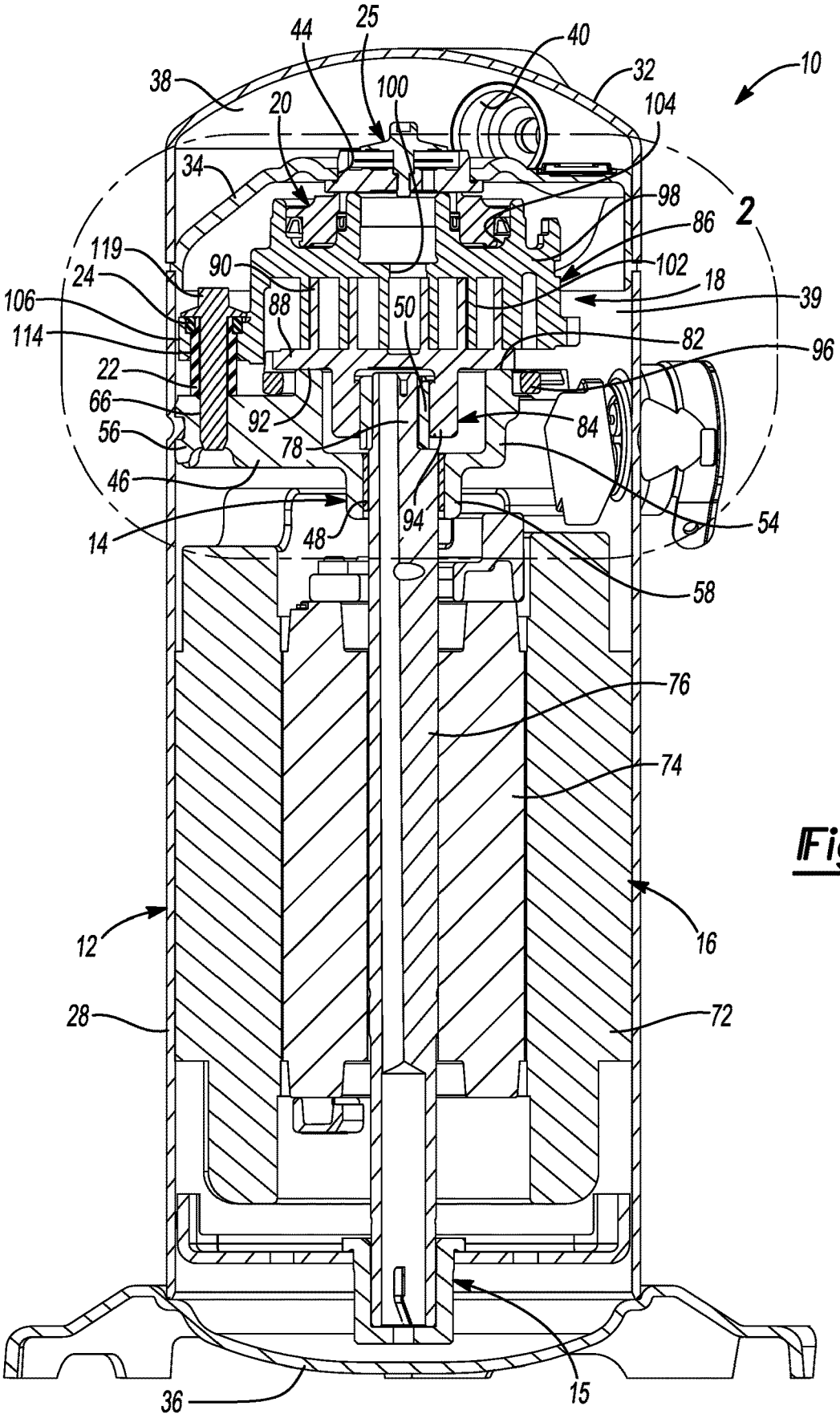
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
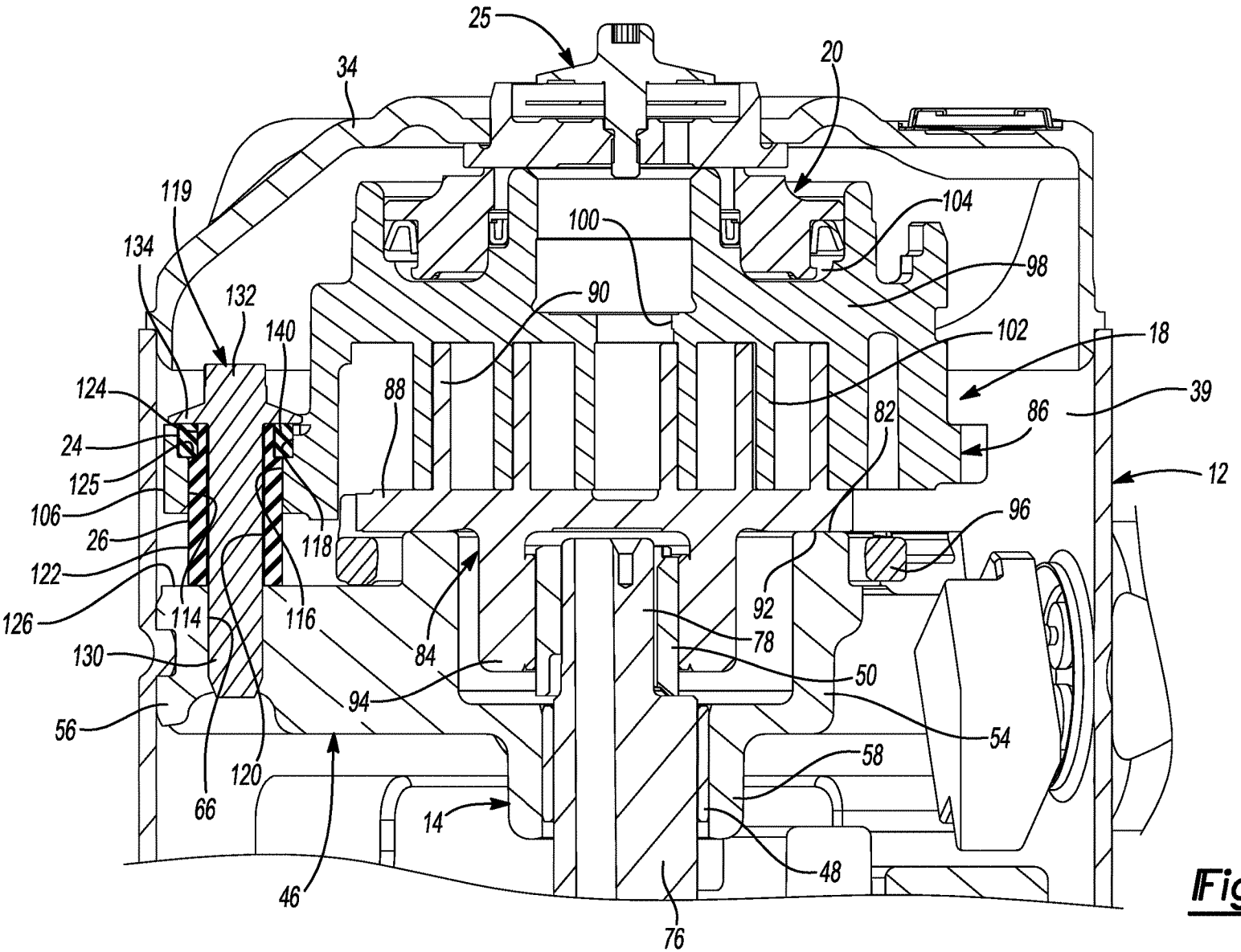
FIG. 2 is a close-up view of an area of the compressor encircled by line 2 in FIG. 1.
Figure 3:
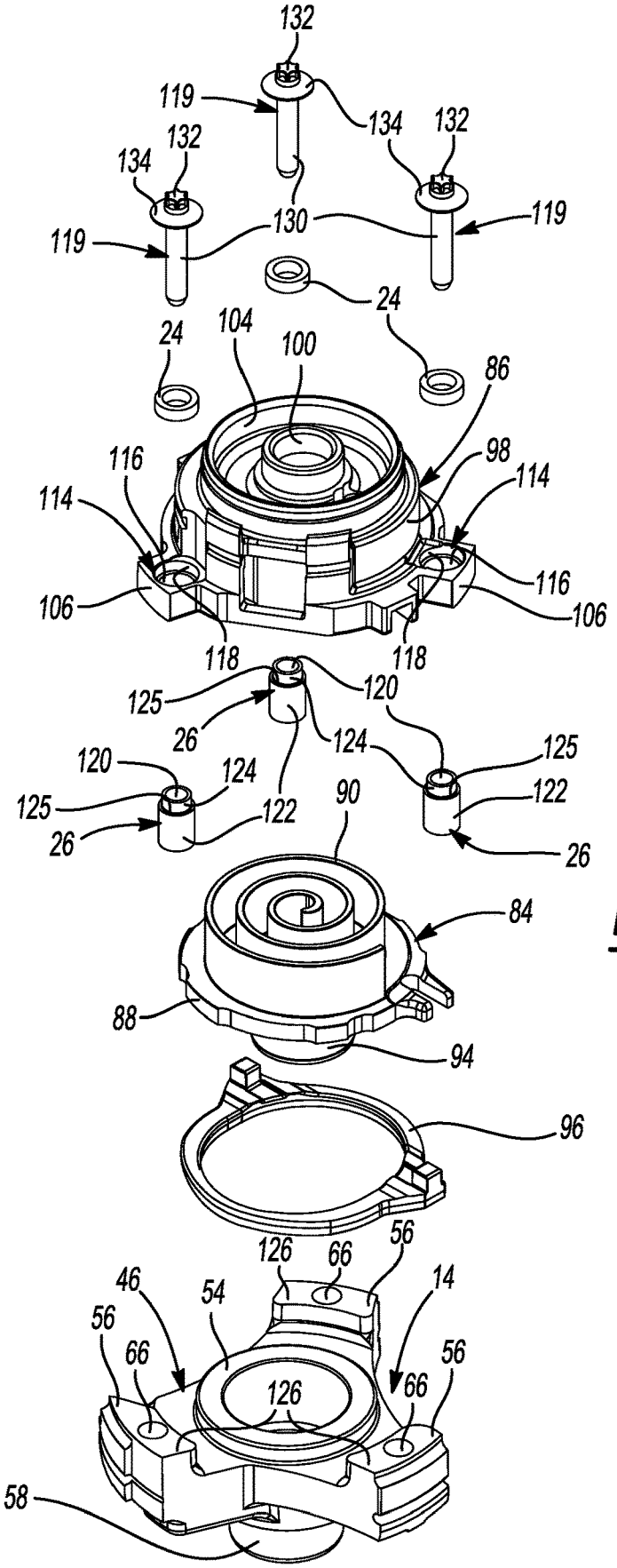
FIG. 3 is an exploded view of a compression mechanism and bearing housing of the compressor of FIG. 1.

With reference to FIGS. 1-3, a compressor 10 is provided and may include a shell assembly 12, a first bearing housing assembly 14, a second bearing housing assembly 15, a motor assembly 16, a compression mechanism 18, a seal assembly 20, a plurality of bushings or sleeve guides 22, a plurality of dampers 24, and a discharge valve assembly 25.

The shell assembly 12 may house the bearing housing assemblies 14, 15, the motor assembly 16, the compression mechanism 18, the seal assembly 20, the bushings 22, the dampers 24, and the discharge valve assembly 25. The shell assembly 12 may generally form a compressor housing and may include a cylindrical shell 28, an end cap 32 at the upper end thereof, a transversely extending partition 34, and a base 36 at a lower end thereof. The end cap 32 and the partition 34 may generally define a discharge chamber 38 (i.e., a discharge-pressure region). The discharge chamber 38 may generally form a discharge muffler for the compressor 10. While illustrated as including the discharge chamber 38, it is understood that the present disclosure applies equally to direct discharge configurations. The shell assembly 12 may define an opening 40 in the end cap 32 forming a discharge outlet. The shell assembly 12 may additionally define a suction inlet (not shown) in communication with a suction chamber 39 (i.e., a suction-pressure region). The partition 34 may include a discharge passage 44 therethrough providing communication between the compression mechanism 18 and the discharge chamber 38.

The first bearing housing assembly 14 may include a first bearing housing 46 and a bearing 48. The first bearing housing 46 may be fixed to the shell 28 in any suitable manner, such as staking, press fit, or welding, for example. The first bearing housing 46 may include a central body 54 with arms 56 extending radially outward from the central body 54. An annular hub 58 may extend from the central body 54 and may include a bore that receives the bearing 48. The arms 56 may be engaged with the shell 28 to fixedly support the first bearing housing 46 within the shell 28. Each of the arms 56 may include an aperture 66 extending at least partially therethrough. The aperture 66 may be threaded.

As shown in FIG. 1, the motor assembly 16 may include a motor stator 72, a rotor 74, and a drive shaft 76. The motor stator 72 may be press fit into the shell 28. The rotor 74 may be press fit on the drive shaft 76 and the drive shaft 76 may be rotationally driven by the rotor 74. The drive shaft 76 may extend through the bore defined by hub 58 and may be rotationally supported by the first bearing housing 46 by the bearing 48.

The drive shaft 76 may include an eccentric crank pin 78 having a flat thereon. A drive bushing 50 may include an inner bore that receives the eccentric crank pin 78. The drive bushing 50 may drivingly engage the compression mechanism 18. The first bearing housing 46 may define a thrust bearing surface 82 supporting the compression mechanism 18.

The compression mechanism 18 may include an orbiting scroll 84 and a non-orbiting scroll 86 meshingly engaged with each another. The orbiting scroll 84 may include an end plate 88 having a spiral vane or wrap 90 on the upper surface thereof and an annular flat thrust surface 92 on the lower surface. The thrust surface 92 may interface with the annular flat thrust bearing surface 82 on the first bearing housing 46. A cylindrical hub 94 may project downwardly from the thrust surface 92 and may receive the drive bushing 50 therein. An Oldham coupling 96 may be engaged with the orbiting scroll 84 and the non-orbiting scroll 86 (or the Oldham coupling 96 may engage the orbiting scroll 84 and the first bearing housing 46) to prevent relative rotation between the orbiting and non-orbiting scrolls 84, 86.

The non-orbiting scroll 86 may include an end plate 98 defining a discharge passage 100 and having a spiral wrap 102 extending from a first side of the end plate 98. The spiral wraps 90, 102 cooperate to define moving compression pockets therebetween. The end plate 98 may include an annular recess 104 that receives the seal assembly 20. The end plate 98 may additionally include a biasing passage (not shown) in fluid communication with the annular recess 104 and an intermediate compression pocket defined by the orbiting and non-orbiting scrolls 84, 86. The seal assembly 20 may form a floating seal assembly and may be sealingly engaged with the non-orbiting scroll 86 to define an axial biasing chamber 110 containing intermediate-pressure working fluid that biases the non-orbiting scroll 86 axially (i.e., in a direction parallel to the rotational axis of the drive shaft 76) toward the orbiting scroll 84. The seal assembly 20 may also engage the partition 34 or a portion of the discharge valve assembly 25 to fluidly isolate the suction chamber 39 from the discharge chamber 38.

The end plate 98 may include a plurality of radially outwardly extending flange portions 106. The flange portions 106 may be axially spaced apart from the arms 56 of the first bearing housing 46. Each of the flange portions 106 includes an aperture 114. Each aperture 114 may receive a fastener 119, one or more of the dampers 24, and one or more of the bushings 26. In the example shown in FIGS. 1-3, each aperture 114 receives one fastener 119, one damper 24, and one bushing 26. As shown in FIGS. 2 and 3, each aperture 114 may include a first portion (e.g., an axially lower portion) 116 having a first diameter and a second portion (e.g., an axially upper portion) 118 having a second diameter that is larger than the first diameter. The first portion 116 may be disposed axially between the second portion 118 and the first bearing housing 46 (i.e., the second portion 118 is disposed axially above the first portion 116 in the example shown in FIG. 2).

The dampers 24 may be solid, annular members, for example. The dampers 24 may be formed from an elastomeric material. For example, suitable elastomeric materials may have proper hardness (e.g., Shore A hardness greater than 40, preferably in the range of 55-95) and the damping factor tans greater than or equal to 0.1 (per ASTM E1604-04, determined in tensile mode, at frequency 60 Hz, 0.1% strain amplitude) between the temperatures of −40° C. and −20° C. The glass transition temperature (per ASTM D6604-00) of the suitable elastomeric materials may be less than or equal to −20° C., and preferably less than −25° C. The suitable material for the elastomeric material may also be refrigerant-compatible and lubricant-compatible. Examples of suitable elastomer materials include natural rubber, synthetic rubber, Ethylene-Propylene rubber, Ethylene-propylene Diene Rubber, Butadiene-Styrene rubber, Nitrile, Butyl, Neoprene, fluorocarbon rubber, polyacrylate rubber, blends of natural and synthetic rubber, composites based on one or more of the above elastomeric materials, and any other suitable elastomeric material with a substantially low glass transition temperature (less than −20° C., and preferably less than −25° C.) and the damping factor greater than or equal to 0.1 between the temperatures of −40° C. and −20° C. For example, the dampers 24 could be formed from Parker Hannifin's VX165, EPDM 0962-90, EPDM 7736-70, or another suitable material. In some configurations, the dampers 24 being formed from an elastomeric material in a solid, annular construction (as shown in the figures) results in greater vibration-reduction and sound-reduction than mechanical springs (e.g., coil springs or leaf springs).

The bushings 26 may be generally cylindrical, annular members. The bushings 26 may be formed from a metallic material or a polymeric material, for example. Each of the bushings 26 may include a bushing aperture 120 that extends axially through axial ends of the bushing 26. Each bushing 26 may include a first portion (e.g., an axially lower portion) 122 having a first outer diameter and a second portion (e.g., an axially upper portion) 124 having a second outer diameter that is smaller than the first outer diameter. The first portion 122 may be disposed axially between the second portion 124 and the first bearing housing 46 (i.e., the second portion 124 is disposed axially above the first portion 122 in the example shown in FIG. 2).

As shown in FIG. 2, the bushings 26 are received in and extend through respective apertures 114. An axial end of the first portion 122 of the bushing 26 may abut a surface 126 of a respective arm 56 of the first bearing housing 46. The dampers 24 may be received on the second portion 124 of respective bushings 26 (i.e., each damper 24 encircles the second portion 124 of a respective bushing 26). Furthermore, the dampers 24 may be at least partially received in the second portion 118 of a respective aperture 114 in the non-orbiting scroll 86. Lower axial ends of the dampers 24 may abut upper axial ends of the first portions 122 of the bushings 26 (i.e., an annular ledge 125 defining a transition between the first and second portions 122, 124 of the bushing 26) and/or lower axial ends of the second portions 118 of the apertures 114 (i.e., an annular ledge defining a transition between the first and second portions 116, 118 of the aperture 114).

As shown in FIGS. 2 and 3, each of the fasteners 119 may include a shaft 130 and a head 132. The shaft 130 may be at least partially threaded. The head 132 may include an integrally-formed, radially-outwardly-extending flange portion 134 (in some configurations, a discrete washer can be provided instead of or in addition to the flange portion 134). The shaft 130 of the fastener 119 may extend through the bushing aperture 120 of a respective bushing 26 and through the aperture 114 of a respective flange portion 106 of the non-orbiting scroll 86. The shaft 130 of each fastener 119 may threadably engage a respective aperture 66 of the first bearing housing 46. The flange portions 134 of the fasteners 119 may abut axial ends of the dampers 24. In some configurations, the outer diameters of the flange portions 134 are larger than the outer diameters of the dampers 24 and can provide a hard stop (in which the flange portions 134 can contact the non-orbiting scroll 86) to limit compression of the dampers 24 and limit axial movement of the non-orbiting scroll 86.

The bushings 26 and fasteners 119 may rotationally fix the non-orbiting scroll 86 relative to the first bearing housing 46 while allowing limited axial displacement of the non-orbiting scroll 86 relative to the first bearing housing 46 and orbiting scroll 84. The dampers 24 may dissipate energy associated with such axial movement of the non-orbiting scroll 86. The dampers 24 may also dissipate energy associated with radial displacement or vibration of the non-orbiting scroll 86.

As shown in FIG. 2, the bushings 26 and non-orbiting scroll 86 define pockets 140 in which the dampers 24 are disposed. That is, the pockets 140 are disposed within the second portions 118 of apertures 114 and surround the second portions 124 of the bushings 26. The pockets 140 are disposed axially between the annular ledges 125 and the flange portions 134 of the fasteners 119. Encapsulating the dampers 24 within the pockets 140 allows for more precision in establishing a predetermined preload of the dampers 24 and improves dissipation of energy to reduce sound.

In some configurations, the dampers 24 may be preloaded (compressed) during assembly of the compressor 10. That is, the dampers 24 may be preloaded (i.e., clamped and compressed) between the flange portions 134 of the fasteners 119 and the annular ledge 125 that defines the transition between the first and second portions 122, 124 of the bushing 26. Such predetermined preload may limit axial displacement and acceleration of the non-orbiting scroll 86 to reduce sound during operation of the compressor 10.

Figure 4:
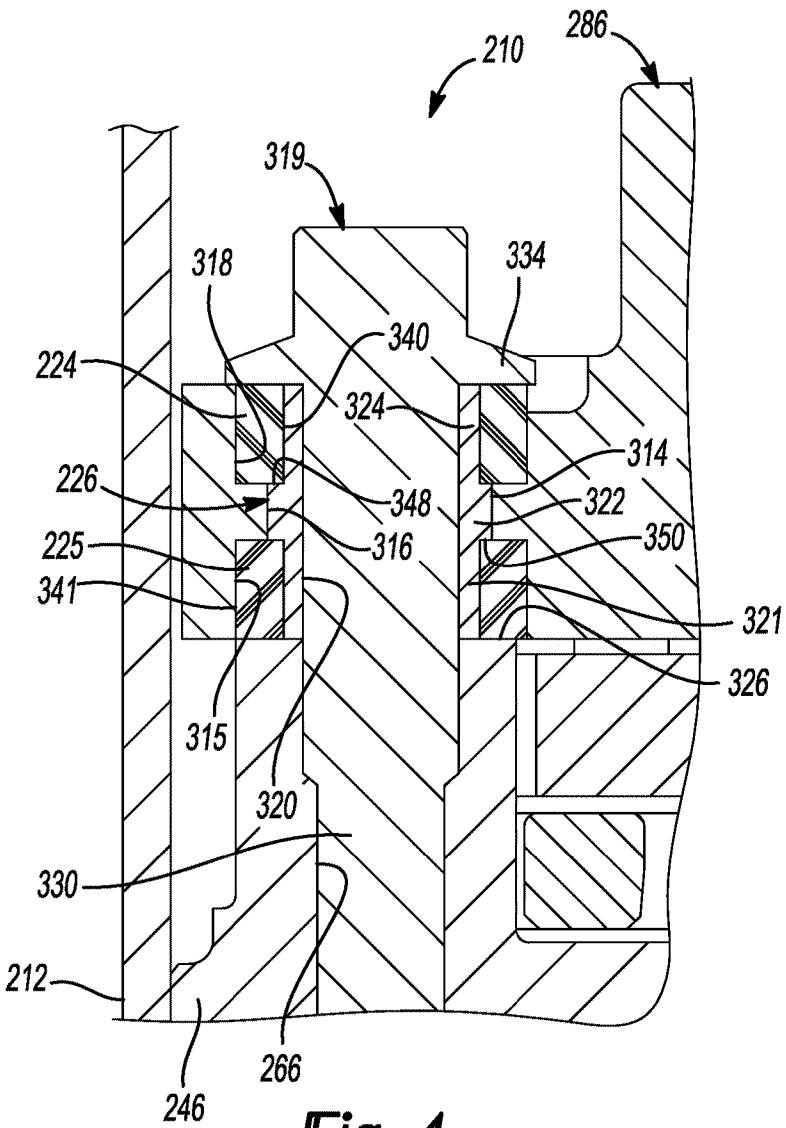
FIG. 4 is a partial cross-sectional view of another compressor according to the principles of the present disclosure.

With reference to FIG. 4, another compressor 210 is provided (only partially shown in FIG. 4). The compressor 210 may be similar or identical to the compressor 10 described above, apart from differences described below.

Like the compressor 10, the compressor 210 includes a first bearing housing 246 fixed to a shell assembly 212. A non-orbiting scroll 286 may include apertures 314 that each receive a bushing 226, a first damper 224, and a second damper 225. Fasteners 319 extend through respective apertures 314, bushings 226, and dampers 224, 225 and may threadably engage respective threaded apertures 266 of the first bearing housing 246 to rotationally fix the non-orbiting scroll 286 relative to the first bearing housing 246 while allowing limited axial displacement of the non-orbiting scroll 286 relative to the first bearing housing 246 and the orbiting scroll. As described above, the dampers 224, 225 may dissipate energy associated with such axial movement of the non-orbiting scroll 286. The dampers 224, 225 may also dissipate energy associated with radial displacement or vibration of the non-orbiting scroll 286.

Each of the apertures 314 of the non-orbiting scroll 286 may include a first portion 316, a second portion 318, and a third portion 315. The first portion 316 may be disposed axially between the second and third portions 318, 315 and may include a first diameter. The second and third portions 318, 315 may include second and third diameters, respectively, that are larger than the first diameter. The second and third diameters may be the same as each other or different from each other.

Each of the bushings 226 may include a first portion 322, a second portion 324, and a third portion 321. The bushings 226 may be received in respective apertures 314 such that the first portions 322 of the bushings 226 are received in the first portions 316 of the apertures 314, the second portions 324 of the bushings 226 are received in the second portions 318 of the apertures 314, and the third portions 321 of the bushings 226 are received in the third portions 315 of the apertures 314. The diameter of the first portion 322 is larger than the diameters of the second and third portions 324, 321. A bushing aperture 320 extends through axial ends of the bushing 226. A shaft 330 of each fastener 319 extends through the bushing aperture 320 of a corresponding bushing 226. A lower axial end of the third portion 321 of the bushing 226 may abut a surface 326 of the first bearing housing 246.

Like the dampers 24 described above, the dampers 224, 225 may be solid, annular members. The dampers 224, 225 may be formed from any of the elastomeric materials described above with respect to the dampers 24.

The first dampers 224 may be received on the second portion 324 of respective bushings 226 (i.e., each damper 224 encircles the second portion 324 of a respective bushing 226). Furthermore, the first dampers 224 may be at least partially received in the second portion 318 of a respective aperture 314 in the non-orbiting scroll 286. Lower axial ends of the first dampers 224 may abut an annular ledge 348 of the bushing 226 that defines a transition between the first and second portions 322, 324 of the bushing 226. Upper axial ends of the first dampers 224 may abut flange portions 334 of the fasteners 319.

In this manner, the first dampers 224 may be received in respective first pockets 340. The first pockets 340 are disposed within the second portions 318 of apertures 314 and surround the second portions 324 of the bushings 226. The first pockets 340 are disposed axially between the annular ledges 348 and the flange portions 334 of the fasteners 319.

The second dampers 225 may be received on the third portion 321 of respective bushings 226 (i.e., each damper 225 encircles the third portion 321 of a respective bushing 226). Furthermore, the second dampers 225 may be at least partially received in the third portion 315 of a respective aperture 314 in the non-orbiting scroll 286. Lower axial ends of the second dampers 225 may abut the surface 326 of the first bearing housing 246. Upper axial ends of the second dampers 225 may abut an annular ledge 350 of the bushing 226 that defines a transition between the first and third portions 322, 321 of the bushing 226.

In this manner, the second dampers 225 may be received in respective second pockets 341. The second pockets 341 are disposed within the third portions 315 of apertures 314 and surround the third portions 321 of the bushings 226. The second pockets 341 are disposed axially between the annular ledges 350 and the surface 326 of the first bearing housing 246. Encapsulating the dampers 224, 225 within the pockets 340, 341 allows for more precision in establishing the preloads of the dampers 224, 225 and improves dissipation of energy to reduce sound.

The first dampers 224 may be preloaded (clamped and compressed between the flange portions 334 of the fasteners 334 and the ledges 348) during assembly of the compressor 210 such that the flange portions 334 of the fasteners 319 may be in contact with the non-orbiting scroll 286 and the upper axial end of the bushing 226. The second dampers 225 may be preloaded (clamped and compressed between the ledges 350 and the surface 326 of the first bearing housing 246) during assembly of the compressor 210 such that the lower axial end of the bushing 226 is in contact with the surface 326 of the first bearing housing 246. Such preloading may reduce sound during operation of the compressor 210. The first and second dampers 224, 225 cooperate to dampen axial movement of the non-orbiting scroll 286 in both axial directions (i.e., both axially upward and axially downward movement).

Figure 5:
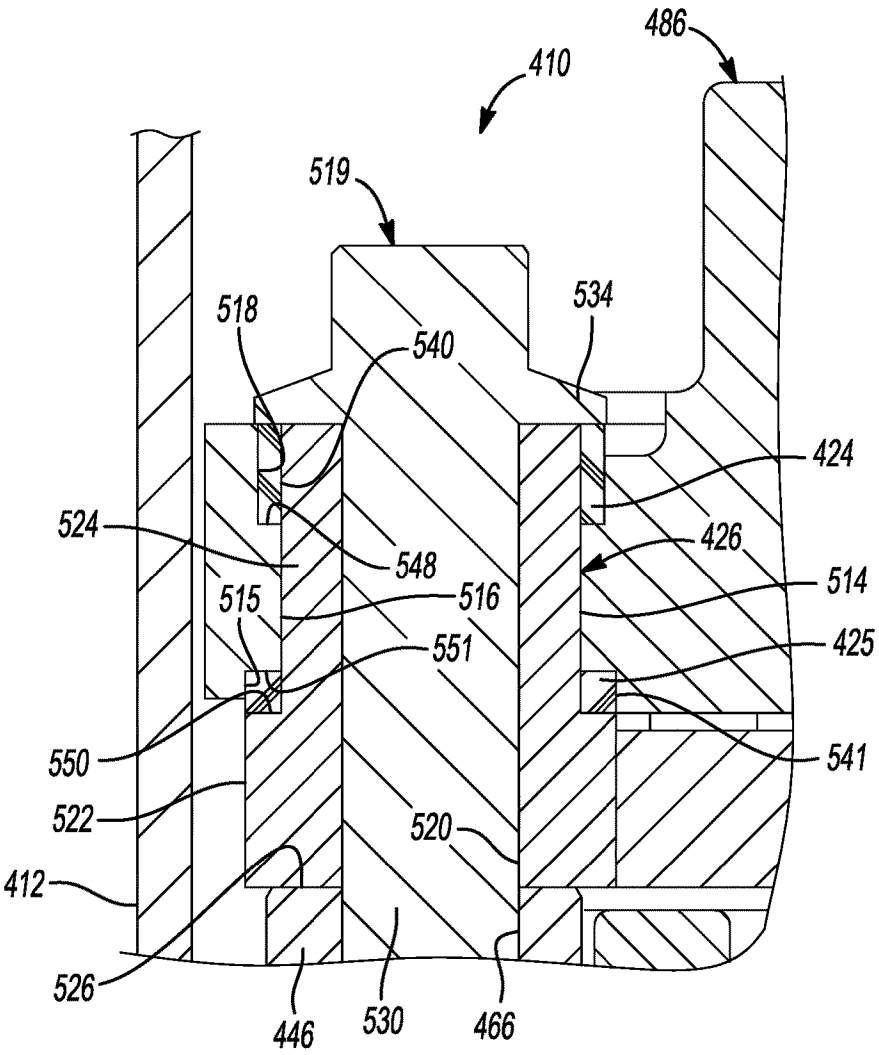
FIG. 5 is a partial cross-sectional view of yet another compressor according to the principles of the present disclosure.

With reference to FIG. 5, another compressor 410 is provided (only partially shown in FIG. 5). The compressor 410 may be similar or identical to the compressor 10, 210 described above, apart from differences described below.

Like the compressor 10, 210, the compressor 410 includes a first bearing housing 446 fixed to a shell assembly 412. A non-orbiting scroll 486 may include apertures 514 that each receive a bushing 426, a first damper 424, and a second damper 425. Fasteners 519 extend through respective apertures 514, bushings 426, and dampers 424, 425 and may threadably engage respective threaded apertures 466 of the first bearing housing 446 to rotationally fix the non-orbiting scroll 486 relative to the first bearing housing 446 while allowing limited axial displacement of the non-orbiting scroll 486 relative to the first bearing housing 446 and the orbiting scroll. As described above, the dampers 424, 425 may dissipate energy associated with such axial movement of the non-orbiting scroll 486. The dampers 424, 425 may also dissipate energy associated with radial displacement or vibration of the non-orbiting scroll 486.

Each of the apertures 514 of the non-orbiting scroll 486 may include a first portion 516, a second portion 518, and a third portion 515. The first portion 516 may be disposed axially between the second and third portions 518, 515 and may include a first diameter. The second and third portions 518, 515 may include second and third diameters, respectively, that are larger than the first diameter. The second and third diameters may be the same as each other or different from each other.

Each of the bushings 426 may include a first portion 522 and a second portion 524. The second portions 524 of the bushings 426 may be received in respective apertures 414 such that the second portions 524 of the bushings 226 extend through the first, second and third portions 516, 518, 515 of the apertures 314. The diameter of the first portion 522 is larger than the diameter of the second portion 524. A bushing aperture 520 extends through axial ends of the bushing 426. A shaft 530 of each fastener 519 extends through the bushing aperture 520 of a corresponding bushing 426. A lower axial end of the first portion 522 of the bushing 426 may abut a surface 526 of the first bearing housing 446.

Like the dampers 24 described above, the dampers 424, 425 may be solid, annular members. The dampers 424, 425 may be formed from any of the elastomeric materials described above with respect to the dampers 24.

The first and second dampers 424, 425 may be received on the second portion 524 of respective bushings 426 (i.e., each damper 224 encircles the second portion 524 of a respective bushing 426). Furthermore, the first dampers 424 may be at least partially received in the second portion 518 of a respective aperture 514 in the non-orbiting scroll 486. Lower axial ends of the first dampers 424 may abut an annular ledge 548 of the non-orbiting scroll 486 that defines a transition between the first and second portions 516, 518 of the aperture 514. Upper axial ends of the first dampers 424 may abut flange portions 534 of the fasteners 519.

In this manner, the first dampers 424 may be received in respective first pockets 540. The first pockets 540 are disposed within the second portions 518 of apertures 514 and surround the second portions 524 of the bushings 426. The first pockets 540 are disposed axially between the annular ledges 548 and the flange portions 534 of the fasteners 519.

The second dampers 425 may be at least partially received in the third portion 515 of a respective aperture 514 in the non-orbiting scroll 486. Lower axial ends of the second dampers 425 may abut an annular ledge 550 of the bushing 426 that defines a transition between the first and second portions 522, 524 of the bushing 426. Upper axial ends of the second dampers 425 may abut an annular ledge 551 of the non-orbiting scroll 486 that defines a transition between the first and third portions 516, 515 of the apertures 514.

In this manner, the second dampers 425 may be received in respective second pockets 541. The second pockets 541 are at least partially disposed within the third portions 515 of apertures 514 and surround the second portions 524 of the bushings 426. The second pockets 541 are disposed axially between the annular ledges 550 of the bushing 426 and the annular ledge 551 of the non-orbiting scroll 486. Encapsulating the dampers 424, 425 within the pockets 540, 541 allows for more precision in establishing the preloads of the dampers 424, 425 and improves dissipation of energy to reduce sound.

The first dampers 424 may be preloaded (clamped and compressed between the flange portions 534 of the fasteners 519 and the ledges 548) during assembly of the compressor 410 such that the flange portions 534 of the fasteners 519 may be in contact with the non-orbiting scroll 486 and the upper axial end of the bushing 426. The second dampers 425 may be preloaded (clamped and compressed between the ledges 550 and the ledges 551) during assembly of the compressor 410. Such preloading may reduce sound during operation of the compressor 410. The first and second dampers 424, 425 cooperate to dampen axial movement of the non-orbiting scroll 486 in both axial directions (i.e., both axially upward and axially downward movement). The dampers 424, 425 may also dampen radial displacement of the non-orbiting scroll 486.

Figure 6:
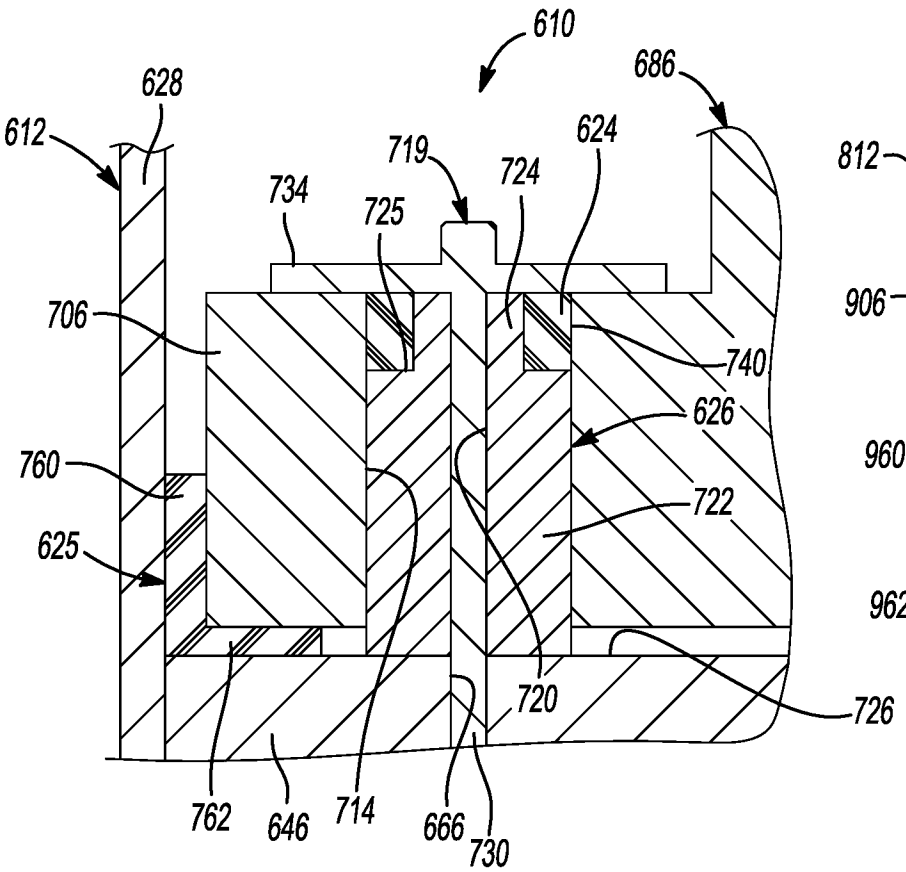
FIG. 6 is a partial cross-sectional view of yet another compressor according to the principles of the present disclosure.

With reference to FIG. 6, another compressor 610 is provided (only partially shown in FIG. 6). The compressor 610 may be similar or identical to the compressor 10, 210, 410 described above, apart from differences described below.

Like the compressor 10, 210, 410, the compressor 610 includes a first bearing housing 646 fixed to a shell assembly 612. A non-orbiting scroll 686 may include apertures 714 that each receive a bushing 626 and a first damper 624. Fasteners 719 extend through respective apertures 714, bushings 626, and dampers 624 and may threadably engage respective threaded apertures 666 of the first bearing housing 646 to rotationally fix the non-orbiting scroll 686 relative to the first bearing housing 646 while allowing limited axial displacement of the non-orbiting scroll 686 relative to the first bearing housing 646 and the orbiting scroll. A second damper 625 may be disposed radially between the non-orbiting scroll 686 and the shell assembly 612 and axially between the non-orbiting scroll 686 and the first bearing housing 646. As described above, the first and second dampers 624, 625 may dissipate energy associated with such axial movement of the non-orbiting scroll 686. The second damper 625 may dissipate energy associated with radial displacement or vibration of the non-orbiting scroll 686. The dampers 624, 625 may be solid, annular members. The dampers 624, 625 may be formed from any of the elastomeric materials described above with respect to the dampers 24.

Each of the bushings 626 may include a bushing aperture 720 that extends axially through axial ends of the bushing 626. The shaft 730 of each fastener 719 extends through the bushing aperture 720 of a respective bushing 626 and threadably engages aperture 666 in the first bearing housing 646. Each bushing 626 may include a first portion (e.g., an axially lower portion) 722 having a first outer diameter and a second portion (e.g., an axially upper portion) 724 having a second outer diameter that is smaller than the first outer diameter. The first portion 722 may be disposed axially between the second portion 724 and the first bearing housing 646.

The bushings 626 are received in and extend through respective apertures 714. An axial end of the first portion 722 of the bushing 626 may abut a surface 726 of the first bearing housing 646. The first dampers 624 may be received on the second portion 724 of respective bushings 626 (i.e., each first damper 624 encircles the second portion 724 of a respective bushing 626). Furthermore, the first dampers 624 may be at least partially received in respective apertures 714 in the non-orbiting scroll 686. Lower axial ends of the first dampers 624 may abut an annular ledge 725 of the bushing 626 (i.e., the annular ledge 725 defines a transition between the first and second portions 722, 724 of the bushing 626). Upper axial ends of the first dampers 624 may abut flange portions 734 of respective fasteners 719.

The bushings 626 and fasteners 719 may rotationally fix the non-orbiting scroll 686 relative to the first bearing housing 646 while allowing limited axial displacement of the non-orbiting scroll 686 relative to the first bearing housing 646 and orbiting scroll. The dampers 624, 625 may dissipate energy associated with such axial movement of the non-orbiting scroll 686. The damper second damper 625 may also dissipate energy associated with radial displacement or vibration of the non-orbiting scroll 686.

The bushings 626 and non-orbiting scroll 686 define pockets 740 in which the first dampers 624 are disposed. That is, the pockets 740 are disposed within the apertures 714 and surround the second portions 724 of the bushings 626. The pockets 740 are disposed axially between the annular ledges 725 and the flange portions 734 of the fasteners 719. Encapsulating the first dampers 624 within the pockets 740 allows for more precision in establishing the preload of the first dampers 624 and improves dissipation of energy to reduce sound.

The second damper 625 may be an annular member having a generally L-shaped cross section. That is, the second damper 625 may include an axially extending portion 760 and a radially extending portion 762 that extends radially inward from a lower axial end of the axially extending portion 760. The axially extending portion 760 may encircle the non-orbiting scroll 686 and may be disposed radially between and in contact with the non-orbiting scroll 686 and the shell assembly 612. The axially extending portion 760 may contact a cylindrical shell 628 (e.g., like cylindrical shell 28 described above) of the shell assembly 612 and flange portions 706 (e.g., like flange portions 106 described above) of the non-orbiting scroll 686. The radially extending portion 762 may be disposed axially between and in contact with the non-orbiting scroll 686 (e.g., the flange portions 706 of the non-orbiting scroll 686) and the first bearing housing 646 (e.g., the surface 726 of the first bearing housing 646).

The first dampers 624 may be preloaded during assembly of the compressor 610 such that the flange portions 734 of the fasteners 719 may be in contact with the non-orbiting scroll 686. That is, the first dampers 624 may be preloaded (i.e., clamped and compressed) between the flange portions 734 of the fasteners 719 and the annular ledge 725. Furthermore, during assembly of the compressor 610, the axially extending portion 760 of the second damper 625 may be radially preloaded between the non-orbiting scroll 686 and the shell assembly 612, and the radially extending portion 762 may be axially preloaded between the non-orbiting scroll 686 and the first bearing housing 646. Such preloading of the dampers 624, 625 may reduce sound during operation of the compressor 610.

Figure 7:
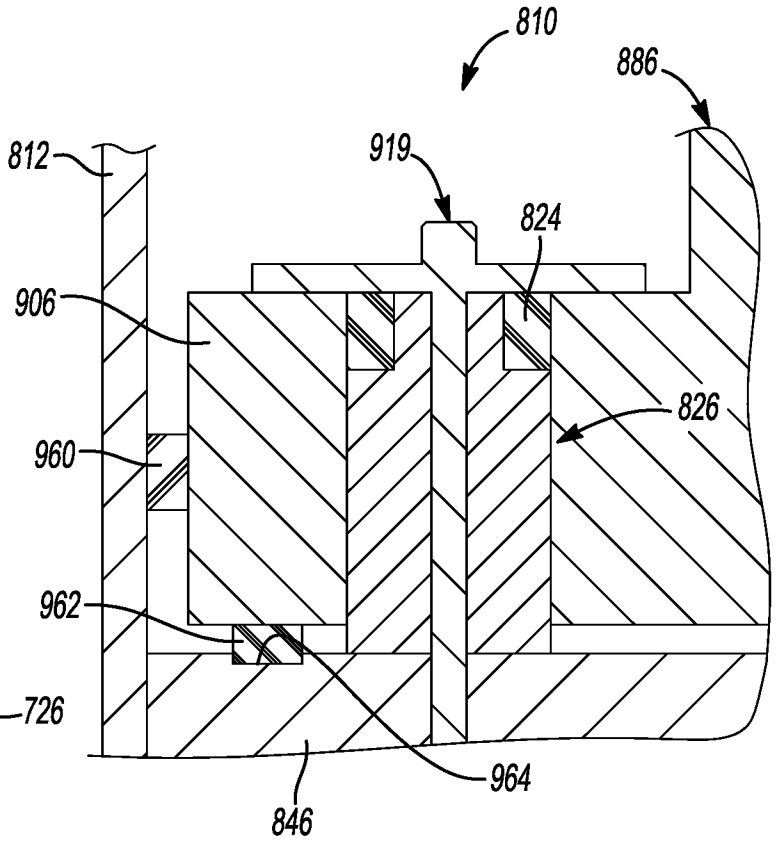
FIG. 7 is a partial cross-sectional view of yet another compressor according to the principles of the present disclosure.

With reference to FIG. 7, another compressor 810 is provided (only partially shown in FIG. 7). The structure and function of the compressor 810 may be similar or identical to that of the compressor 610 described above, apart from differences described below. Therefore, similar features will not be described again in detail.

A shell assembly 812, first bearing housing 846, non-orbiting scroll 886, first damper 824, bushing 826, and fastener 919 of the compressor 810 may be identical to the shell assembly 612, first bearing housing 646, non-orbiting scroll 686, first damper 624, bushing 626, and fastener 719 of the compressor 610 described above. Therefore, these components and their functions will not be described again.

However, in the compressor 810, the second damper 625 has been replaced with an alternative second damper 960 and a third damper 962. The second and third dampers 960, 962 may have similar or identical functions as the axially extending portion 760 and radially extending portion 762 of the second damper 625 described above. The primary difference between the second and third dampers 960, 962 and the axially extending and radially extending portions 760, 762 of the second damper 625 is that the second and third dampers 960, 962 are separate and discrete components and are not integrally formed like the axially extending and radially extending portions 760, 762 of the second damper 625.

The second damper 960 may be an annular member that encircles the non-orbiting scroll 886 and may be disposed radially between and in contact with the non-orbiting scroll 886 and the shell assembly 812. In some configurations, instead of an annular second damper 960 that encircles the non-orbiting scroll 886, a plurality of discrete second dampers 960 can be positioned between (and in contact with) the shell assembly 812 and respective flange portions 906 of the non-orbiting scroll 886. The third damper 962 may an annular member disposed axially between and in contact with the non-orbiting scroll 886 and the first bearing housing 846. The third damper 962 can be received in a recess or an annular groove 964 in the first bearing housing 846. In some configurations, the third damper 962 may be a continuous ring (i.e., that extends around a rotational axis of a driveshaft of the compressor 810). In other configurations, the compressor 810 could have multiple third dampers 962 (instead of a single annular third damper 962), each of which can be positioned between a respective flange portion 906 (like flange portions 106) of the non-orbiting scroll 886 and the first bearing housing 846.

Figure 9:
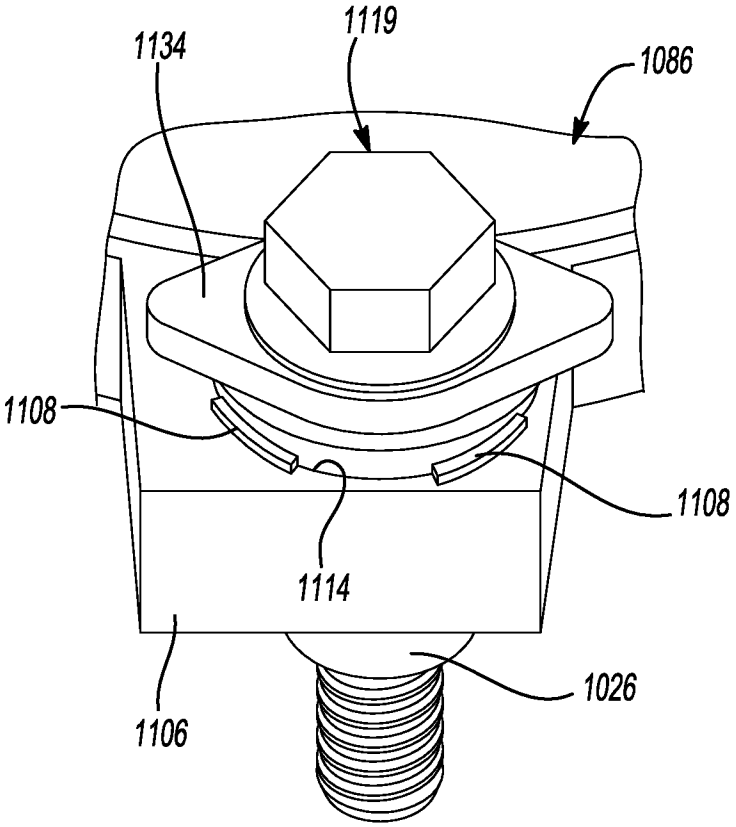
FIG. 9 is a partially exploded perspective view of a non-orbiting scroll and fastener of the compressor of FIG. 8.
Figure 8:
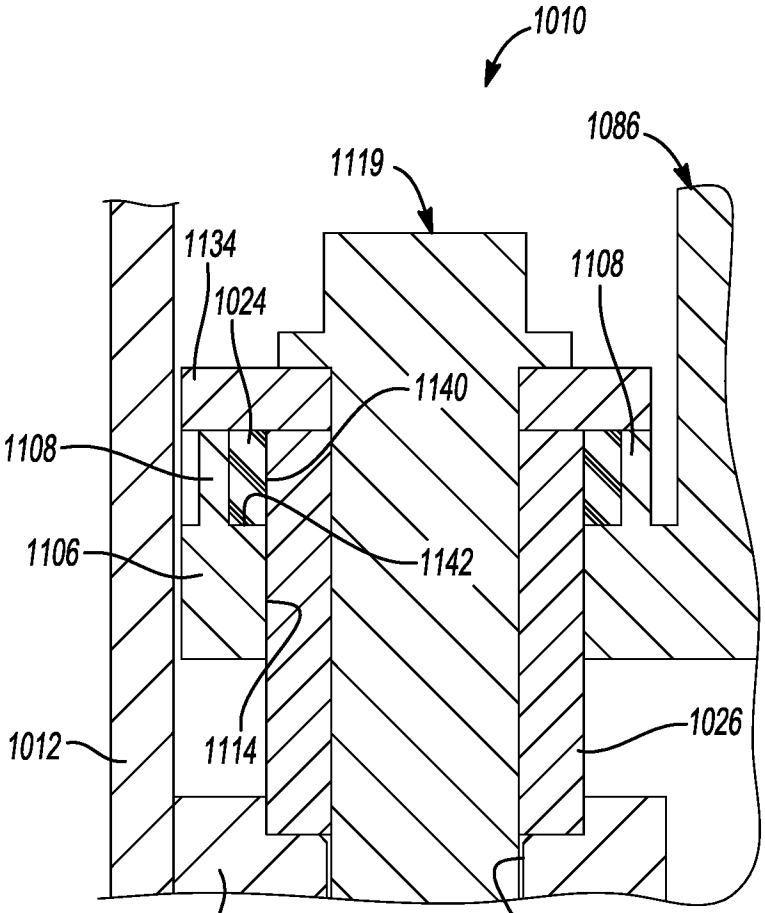
FIG. 8 is a partial cross-sectional view of yet another compressor according to the principles of the present disclosure.

With reference to FIGS. 8 and 9, another compressor 1010 is provided. The compressor 1010 may be similar or identical to the compressor 10, 210, 410, 610, 810 described above, apart from differences described below.

Like the compressor 10, 210, 410, 610, 810, the compressor 1010 includes a first bearing housing 1046 fixed to a shell assembly 1012. A non-orbiting scroll 1086 may include flange portions 1106 that each include an aperture 1114 that each receive a bushing 1026, a damper 1024, and a fastener 1119. Fasteners 1119 extend through respective apertures 1114, bushings 1026, and dampers 1024 and may threadably engage respective threaded apertures 1066 of the first bearing housing 1046 to rotationally fix the non-orbiting scroll 1086 relative to the first bearing housing 1046 while allowing limited axial displacement of the non-orbiting scroll 1086 relative to the first bearing housing 1046 and the orbiting scroll. As described above, the dampers 1024 may dissipate energy associated with such axial movement of the non-orbiting scroll 1086. The dampers 1024 may also dissipate energy associated with radial displacement or vibration of the non-orbiting scroll 1086.

Each flange portion 1106 of the non-orbiting scroll 1086 may include a plurality of protrusions 1108 that extend axially toward a flange portion (or washer) 1134 of the fastener 1119 (i.e., axially upward in the configuration shown in FIGS. 8 and 9). The protrusions 1108 may be arranged in a circular pattern around the aperture 1114 and are circumferentially spaced apart from each other. A pocket 1140 may be formed radially between the protrusions 1108 and an outer diametrical surface of the bushing 1026 and axially between an annular ledge 1142 of the non-orbiting scroll 1086 and the flange portion 1134 of the fastener 1119. The damper 1024 may be disposed within the pocket 1140. A lower axial end of the damper 1024 may abut the annular ledge 1142, and an upper axial end of the damper 1024 may abut the flange portion 1134 of the fastener 1119.

The dampers 1024 may be preloaded (clamped and compressed between the ledges 550 and the flange portions 1134) during assembly of the compressor 1010. Such preloading may reduce sound during operation of the compressor 1010. The dampers 1024 cooperate to dampen axial and radial movement of the non-orbiting scroll 1086. The circumferential spacing between the protrusions 1108 of the non-orbiting scroll 1086 can be selected to tune the preloading to a desired value.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly;

an orbiting scroll disposed within the shell assembly and including a first end plate and a first spiral wrap extending from the first end plate;

a non-orbiting scroll including a second end plate and a second spiral wrap extending from the second end plate, the second spiral wrap cooperating with the first spiral wrap to define compression pockets therebetween;

a bearing housing fixed relative to the shell assembly and including a first aperture;

a bushing having an axial end abutting the bearing housing, the bushing extending through a second aperture of the non-orbiting scroll, the bushing including a first portion having a first diameter and a second portion having a second diameter that is smaller than the first diameter, the bushing having a third aperture extending axially therethrough;

a first damper received on the bushing, the first damper at least partially disposed within the second aperture and encircling the second portion of the bushing; and a fastener including a shaft portion and a flange portion, the shaft portion extending through the third aperture and into the first aperture, the flange portion contacting a first axial end of the first damper, wherein a second axial end of the first damper contacts an annular ledge of the bushing, and wherein the annular ledge of the bushing defines a transition between the first and second portions of the bushing, and wherein the compressor further comprises a second damper disposed within the second aperture of the non-orbiting scroll, wherein an axial end of the second damper contacts another annular ledge of the bushing.

2. The compressor of claim 1, wherein the first damper is a solid annular member formed from an elastomeric material.

3. The compressor of claim 2, wherein the elastomeric material has a glass transition temperature less than or equal to −20° C., a hardness within the range of 40-95 Shore A, and a damping factor greater than or equal to 0.1 between temperatures of −40° C. and −20° C.

4. The compressor of claim 1, wherein the second aperture of the non-orbiting scroll includes a first portion having a first diameter and a second portion having a second diameter that is larger than the first diameter of the first portion of the second aperture.

5. The compressor of claim 4, wherein the first damper is at least partially disposed within the second portion of the second aperture of the non-orbiting scroll.

6. The compressor of claim 5, wherein the first damper contacts an annular ledge of the non-orbiting scroll that defines a transition between the first and second portions of the second aperture of the non-orbiting scroll.

7. The compressor of claim 1, wherein another axial end of the second damper contacts a surface of the bearing housing.

8. The compressor of claim 1, wherein another axial end of the second damper contacts an annular ledge of the non-orbiting scroll.

9. The compressor of claim 1, wherein the first damper is clamped between the flange portion of the fastener and a surface of the bushing such that the flange portion of the fastener contacts an axial end of the bushing.

10. A compressor comprising:

a shell assembly;

an orbiting scroll disposed within the shell assembly and including a first end plate and a first spiral wrap extending from the first end plate;

a non-orbiting scroll including a second end plate and a second spiral wrap extending from the second end plate, the second spiral wrap cooperating with the first spiral wrap to define compression pockets therebetween;

a bearing housing fixed relative to the shell assembly and including a first aperture;

a bushing having an axial end abutting the bearing housing, the bushing extending through a second aperture of the non-orbiting scroll, the bushing having a third aperture extending axially therethrough;

a first damper received in a pocket defined by and disposed radially between an outer diametrical surface of the bushing and an inner diametrical surface of the non-orbiting scroll, the first damper at least partially disposed within the second aperture and encircling at least a portion of the bushing; and a fastener including a shaft portion and a flange portion, the shaft portion extending through the third aperture and into the first aperture, the flange portion contacting a first axial end of the first damper, wherein the non-orbiting scroll includes a plurality of protrusions arranged in a circular pattern around the bushing, and wherein the protrusions contact the fastener.

11. The compressor of claim 10, wherein the first damper is a solid annular member formed from an elastomeric material, and wherein the elastomeric material has a glass transition temperature less than or equal to −20° C., a hardness within the range of 40-95 Shore A, and a damping factor greater than or equal to 0.1 between temperatures of −40° C. and −20° C.

12. The compressor of claim 10, wherein a second axial end of the first damper contacts an annular ledge of the bushing, wherein the annular ledge of the bushing defines a transition between first and second portions of the bushing, wherein the first portion of the bushing has a first diameter, wherein the second portion of the bushing has a second diameter that is different than the first diameter.

13. The compressor of claim 12, wherein the second aperture of the non-orbiting scroll includes a first portion having a first diameter and a second portion having a second diameter that is larger than the first diameter of the first portion of the second aperture.

14. The compressor of claim 13, wherein the first damper is at least partially disposed within the second portion of the second aperture of the non-orbiting scroll, and wherein the first damper contacts an annular ledge of the non-orbiting scroll that defines a transition between the first and second portions of the second aperture of the non-orbiting scroll.

15. The compressor of claim 14, further comprising a second damper disposed within the second aperture of the non-orbiting scroll, wherein an axial end of the second damper contacts another annular ledge of the bushing.

16. The compressor of claim 15, wherein another axial end of the second damper contacts a surface of the bearing housing.

17. The compressor of claim 15, wherein another axial end of the second damper contacts an annular ledge of the non-orbiting scroll.

18. The compressor of claim 10, wherein the first damper is clamped between the flange portion of the fastener and a surface of the bushing such that the flange portion of the fastener contacts an axial end of the bushing.

19. A compressor comprising:

a shell assembly;

an orbiting scroll disposed within the shell assembly and including a first end plate and a first spiral wrap extending from the first end plate;

a non-orbiting scroll including a second end plate and a second spiral wrap extending from the second end plate, the second spiral wrap cooperating with the first spiral wrap to define compression pockets therebetween;

a bearing housing fixed relative to the shell assembly and including a first aperture;

a bushing having an axial end abutting the bearing housing, the bushing extending through a second aperture of the non-orbiting scroll, the bushing having a third aperture extending axially therethrough;

a first damper received in a pocket defined by and disposed radially between an outer diametrical surface of the bushing and an inner diametrical surface of the non-orbiting scroll, the first damper at least partially disposed within the second aperture and encircling at least a portion of the bushing;

a fastener including a shaft portion and a flange portion, the shaft portion extending through the third aperture and into the first aperture, the flange portion contacting a first axial end of the first damper; and a second damper contacting the shell assembly and the non-orbiting scroll, wherein at least a portion of the second damper is disposed radially between the non-orbiting scroll and the shell assembly, wherein another portion of the second damper is disposed axially between and in contact with the non-orbiting scroll and the bearing housing, and wherein the second damper is an annular member that surrounds the non-orbiting scroll.

20. The compressor of claim 19, wherein a second axial end of the first damper contacts an annular ledge of the bushing.

* * * * *